US009669620B2

(12) United States Patent
Hayashi

(10) Patent No.: US 9,669,620 B2
(45) Date of Patent: Jun. 6, 2017

(54) LIQUID DROPLET EJECTING DEVICE, IMAGE FORMING APPARATUS, AND METHOD FOR DETECTING ABNORMAL EJECTION OF LIQUID DROPLET EJECTING HEAD

(71) Applicant: Ryuichi Hayashi, Kanagawa (JP)

(72) Inventor: Ryuichi Hayashi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/237,818

(22) Filed: Aug. 16, 2016

(65) Prior Publication Data

US 2017/0057217 A1 Mar. 2, 2017

(30) Foreign Application Priority Data

Aug. 26, 2015 (JP) ..... 2015-167211
Jul. 14, 2016 (JP) ..... 2016-139743

(51) Int. Cl.
*B41J 2/045* (2006.01)

(52) U.S. Cl.
CPC ..... *B41J 2/0451* (2013.01); *B41J 2/04541* (2013.01); *B41J 2/04581* (2013.01); *B41J 2/04588* (2013.01); *B41J 2202/13* (2013.01)

(58) Field of Classification Search
CPC ..... B41J 2/0451; B41J 2/2139; B41J 2/2142; B41J 2/16579; B41J 2002/165
See application file for complete search history.

(56) References Cited

U.S. PATENT DOCUMENTS 9,085,134 B2 7/2015 Otokita
2011/0084996 A1* 4/2011 Hirato ..... B41J 2/0451 347/10
2015/0191017 A1* 7/2015 Matsumoto ..... B41J 2/165 347/22

(Continued)

FOREIGN PATENT DOCUMENTS

JP 2011-140118 7/2011
JP 2015-047803 3/2015

OTHER PUBLICATIONS

U.S. Appl. No. 15/063,747, filed Mar. 8, 2016.
U.S. Appl. No. 15/186,732, filed Jun. 20, 2016.

*Primary Examiner* — Julian Huffman
(74) *Attorney, Agent, or Firm* — IPUSA, PLLC

(57) ABSTRACT

A liquid droplet ejecting device is provided that includes a liquid droplet ejecting head having a nozzle, a pressure chamber that accommodates liquid and is in communication with the nozzle, and a piezoelectric element that is arranged to face the pressure chamber; a drive waveform generation unit configured to generate a drive waveform that drives the piezoelectric element and has a potential that varies with respect to a reference potential; a detection unit configured to detect a relationship between a detected potential of a residual oscillation waveform that is generated within the pressure chamber after driving the piezoelectric element and a first threshold corresponding to a potential higher than the reference potential; and a state determination unit configured to determine whether the nozzle and/or the pressure chamber is in an abnormal state based on the detected relationship between the detected potential and the first threshold.

16 Claims, 15 Drawing Sheets

(56) References Cited

U.S. PATENT DOCUMENTS

| | | | | |
|---|---|---|---|---|
| 2015/0258780 | A1 | 9/2015 | Hayashi | |
| 2015/0352841 | A1 | 12/2015 | Horie | |
| 2015/0367633 | A1* | 12/2015 | Murate | B41J 2/04588 347/10 |
| 2016/0107440 | A1 | 4/2016 | Kanzawa | |
| 2016/0167364 | A1* | 6/2016 | Matsumoto | B41J 2/0451 347/9 |

* cited by examiner

| NOZZLE STATE DETERMINATION | STATE |
|---|---|
| Vth1 < Vrs | NORMAL EJECTION STATE |
| Vth2 < Vrs ≤ Vth1 | DRY STATE |
| Vrs < Vth2 | BUBBLE MIXED STATE |

LIQUID DROPLET EJECTING DEVICE, IMAGE FORMING APPARATUS, AND METHOD FOR DETECTING ABNORMAL EJECTION OF LIQUID DROPLET EJECTING HEAD

CROSS-REFERENCE TO RELATED APPLICATIONS

The present application claims priority under 35 U.S.C. §119 to Japanese Patent Application No. 2015-167211 filed on Aug. 26, 2015 and Japanese Patent Application No. 2016-139743 filed on Jul. 14, 2016, the entire contents of which are incorporated herein by reference.

BACKGROUND OF THE INVENTION

1. Field of the Invention

The present invention relates to a liquid droplet ejecting device, an image forming apparatus, and a method for detecting abnormal ejection of a liquid droplet ejecting head.

2. Description of the Related Art

Inkjet printers can form desired characters and figures on a recording medium (e.g., paper, metal, wood, or ceramics) using an inkjet recording head that includes, for example, a nozzle for ejecting ink droplets, a pressure chamber that is in communication with the nozzle, and a piezoelectric element for applying pressure to ink within the pressure chamber.

The recording head of an inkjet printer has a plurality of nozzles for ejecting ink droplets. However, when one or more of the nozzles become clogged due to drying of the nozzles, thickening (increased viscosity) of the ink within the pressure chamber, or bubbles entering the pressure chamber, for example, the nozzles may be unable to eject ink droplets and a printed image may have missing dots to thereby result in image quality degradation.

Particularly, in continuous feed inkjet printers that can form an image at high speed by continuously applying a drive waveform to a recording head, when image quality is degraded due to nozzle clogging such that a resulting printed product fails to meet desired print quality, printing will have to be performed all over again to have a huge impact on productivity, for example.

Thus, techniques are known for detecting nozzle clogging, such as residual oscillation detection. In residual oscillation detection, oscillation of a nozzle surface (hereinafter referred to as "meniscus") after ink droplet ejection is propagated and the state of the meniscus is detected based on a change in the oscillation pattern of a counter electromotive voltage that is generated.

For example, Japanese Unexamined Patent Publication No. 2015-47803 describes an example nozzle clogging detection method using the residual oscillation detection technique that involves setting the period of a residual oscillation waveform as a parameter to detect nozzle clogging.

SUMMARY OF THE INVENTION

According to one embodiment of the present invention, a liquid droplet ejecting device is provided that includes a liquid droplet ejecting head having a nozzle, a pressure chamber that accommodates liquid and is in communication with the nozzle, and a piezoelectric element that is arranged to face the pressure chamber; a drive waveform generation unit configured to generate a drive waveform that drives the piezoelectric element and has a potential that varies with respect to a reference potential; a detection unit configured to detect a relationship between a detected potential of a residual oscillation waveform that is generated within the pressure chamber after driving the piezoelectric element and a first threshold corresponding to a potential higher than the reference potential of the drive waveform; and a state determination unit configured to determine whether the nozzle and/or the pressure chamber is in an abnormal state based on the detected relationship between the detected potential of the residual oscillation waveform and the first threshold.

DESCRIPTION OF THE EMBODIMENTS

Figure 1:
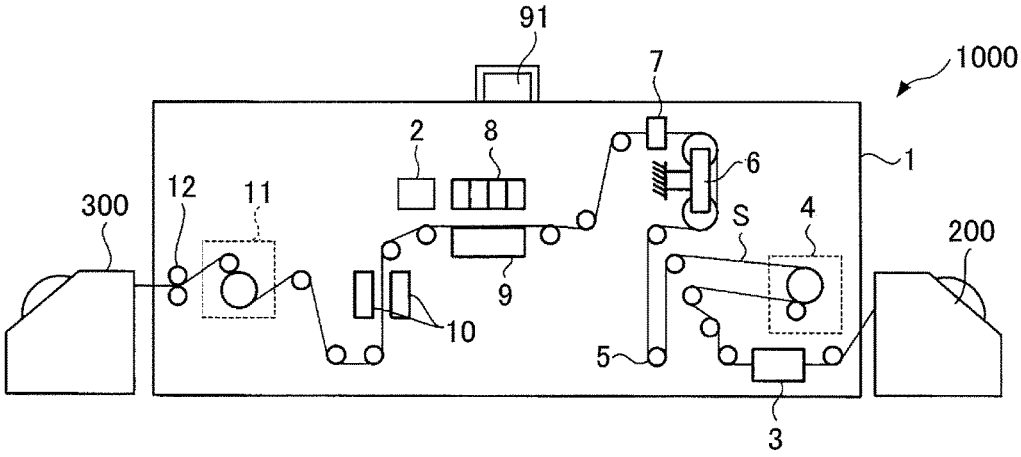
FIG. 1 is a diagram illustrating an inkjet recording apparatus according to an embodiment of the present invention.

According to one aspect of the present invention, a liquid droplet ejecting device is provided that is capable of detecting abnormal ejection while maintaining productivity.

In the following, embodiments of the present invention are described with reference to the accompanying drawings. Note that elements and features in the drawings that are substantially identical are given the same reference numerals and overlapping descriptions may be omitted.

<Inkjet Recording Apparatus>

FIG. 1 is a schematic diagram illustrating an example configuration of an on-demand type line scanning inkjet recording apparatus 1 of a print system 100 according to an embodiment of the present invention. In FIG. 1, the print system 1000 includes the inkjet recording apparatus 1, a recording medium feed unit 200, and a recording medium collection unit 300.

The inkjet recording apparatus 1 is an example of an image forming apparatus according to an embodiment of the present invention and includes a restriction guide 3, an in-feed unit 4, a dancer roller 5, an EPC (edge position controller) 6, a conveyance meandering detector 7, an inkjet recording module 8, a platen 9, a maintenance/restoration module 2, a drying module 10, an out-feed unit 11, and a puller 12.

The restriction guide 3 performs positioning of a recording medium S in its width direction. The in-feed roller 4 includes a drive roller and a driven roller that are configured to maintain a tension force of the recording medium S constant. The dancer roller 5 outputs a positioning signal by moving in a vertical direction in accordance with the tension force of the recording medium S. The EPC (edge position controller) 6 controls positions of edges of the recording medium S. The platen 9 is arranged to face the inkjet recording module 8. The out-feed unit 11 includes a driving roller and a driven roller that are configured to drive and convey the recording medium S at a preset speed. The puller 12 includes a driving roller and a driven roller that are configured to discharge the recording medium S outside of the inkjet recording apparatus 1.

The inkjet recording module 8 is an example of a liquid droplet ejecting device according to an embodiment of the present invention and includes a line head (recording head 15) in which nozzles (print nozzles, ejection holes) 16 (see FIG. 4) are arranged across an entire printing width. Color printing is performed using line heads for the colors black, cyan, magenta, and yellow. In a printing operation, nozzle surfaces of the line heads 15 are supported so that a predetermine gap is maintained between the nozzle surfaces and the platen 9. The inkjet recording module 8 ejects ink in accordance with the conveying speed of the recording medium S to form a color image on the recording medium S.

The maintenance/restoration module 2 performs an appropriate maintenance/restoration operation on the inkjet recording module 8 installed in the inkjet recording apparatus (image forming apparatus) 1 to restore the ejection performance of the inkjet recording heads 15.

Also, an operation panel 91 is attached to a housing of the inkjet recording apparatus 1 as a user interface for enabling a user to input information.

Note that in the present embodiment, the inkjet recording apparatus 1 is arranged into a line scanning type inkjet recording apparatus to enable high-speed image formation.

<Inkjet Recording Module>

Figure 2:
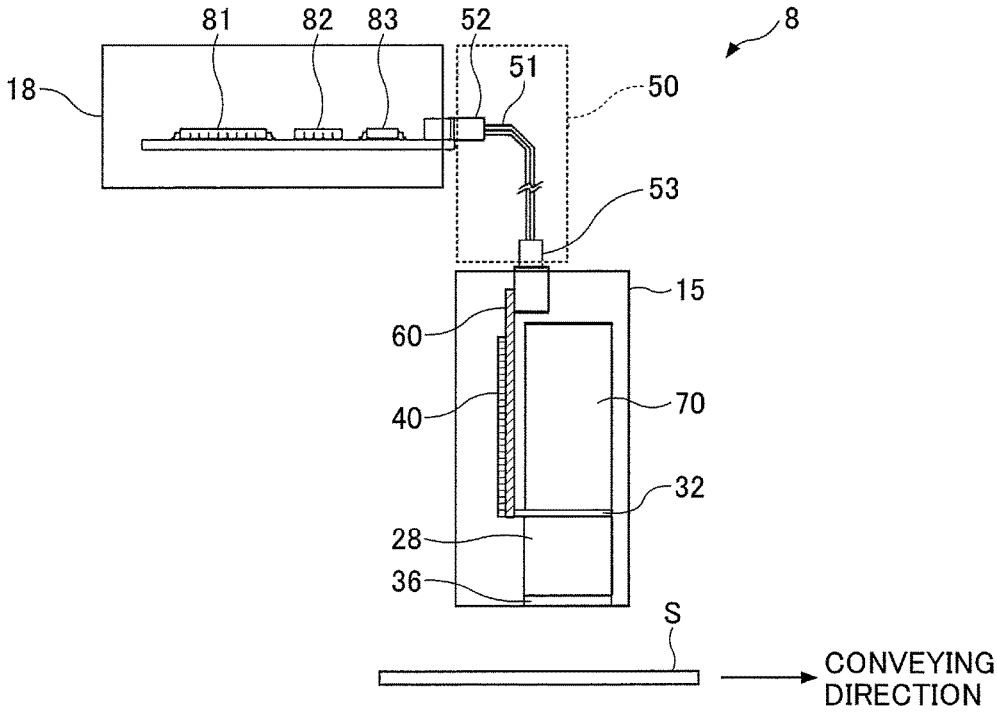
FIG. 2 is a side view of a liquid droplet ejecting device according to an embodiment of the present invention.

FIG. 2 is a side view of the inkjet recording module 8. As illustrated in FIG. 2, the inkjet recording module 8 includes a drive control substrate 18, an inkjet recording head 15, and a connection unit 50.

Figure 9:
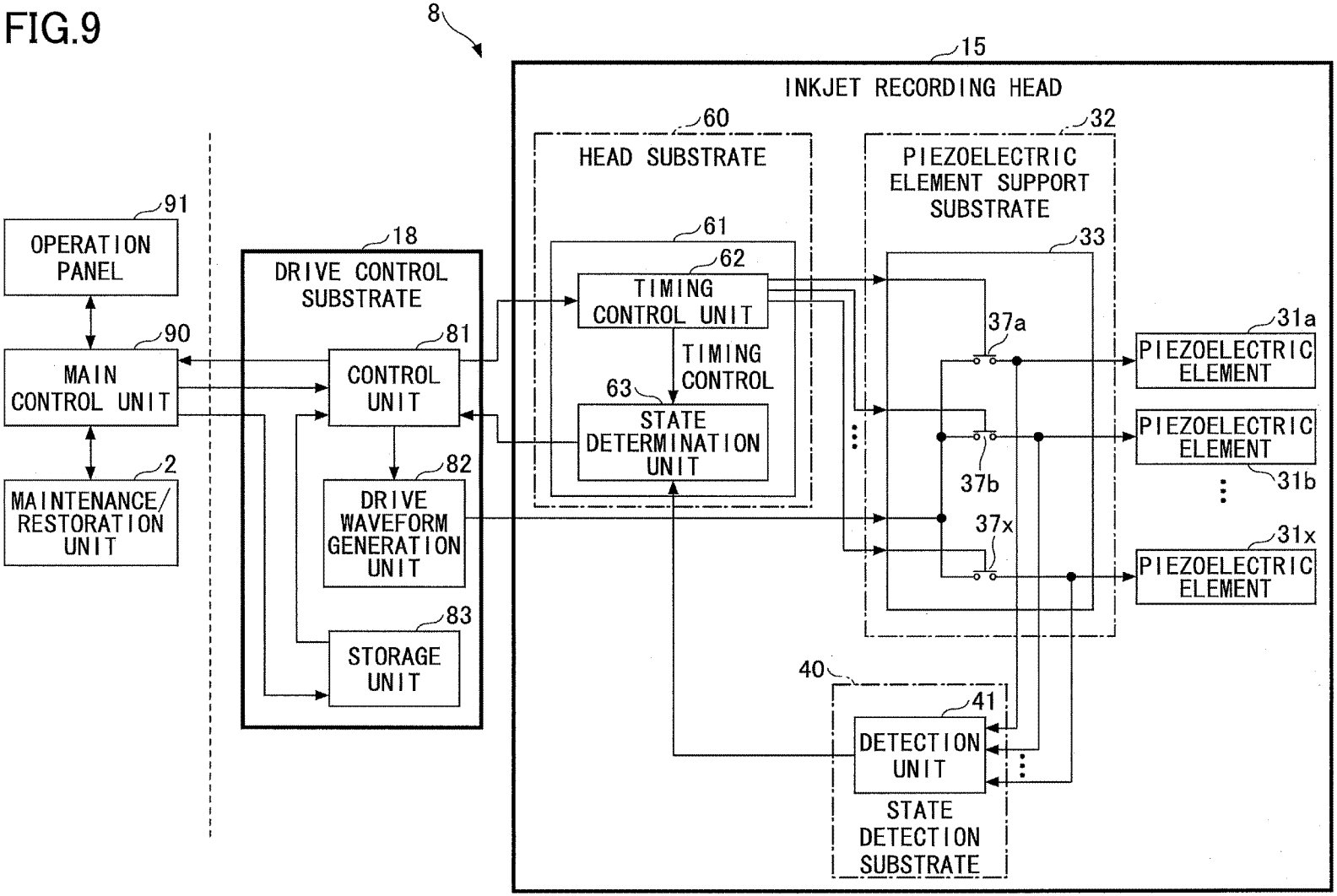
FIG. 9 is a block diagram illustrating the liquid droplet ejecting device including the recording head and a drive control substrate according to an embodiment of the present invention.

The drive control substrate 18 includes a control unit 81, a drive waveform generation unit 82, and a storage unit 83 (see FIG. 9).

In the connection unit 50, a cable 51 connects a drive control substrate side connector 52 and a head side connector 53. In this way, the connection unit 50 enables transmission/reception of analog signals and digital signals between the drive control substrate 18 and a head substrate 60 included in the recording head 15.

The recording head (also referred to as "inkjet recording head unit" or "liquid droplet ejecting head") 15 includes a control drive unit, which is configured by the head substrate 60, a state detection substrate 40, and a piezoelectric element support substrate (head drive IC substrate) 32. Also, the recording head 15 includes a plurality of plates that are stacked one on top of the other (see FIG. 5) as a structure for ejecting ink.

Figure 5:
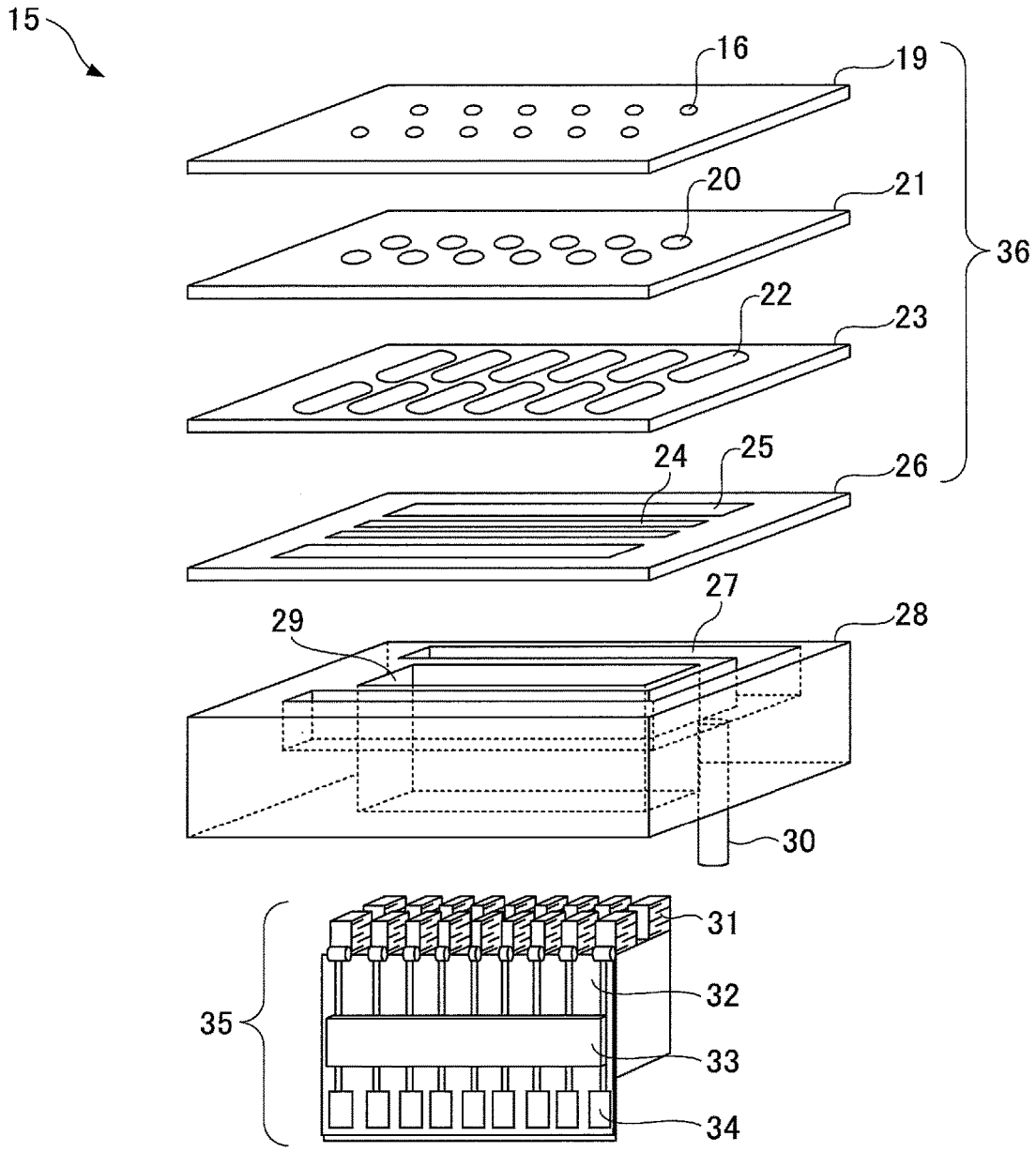
FIG. 5 is an exploded perspective view of the recording head according to an embodiment of the present invention.

The recording head 15 includes a rigid plate 28 that accommodates piezoelectric elements 31, and a channel plate 36 that has the nozzles 16 and pressure chambers (also referred to as "individual pressure generating chambers" or "liquid chambers") 20 formed therein (see FIG. 5). Further, an ink tank 70 containing ink is arranged near the piezoelectric element support substrate 32 within the recording head 15.

In the line scanning type inkjet recording apparatus 1 of the present embodiment, the recording head 15 is arranged in a direction orthogonal to a conveying direction of the recording medium S.

However, the structure of an inkjet recording apparatus (image forming apparatus) according to an embodiment of the present invention is not limited to such a line scanning type inkjet recording apparatus. In alternative embodiments, other types of image forming apparatuses with liquid droplet ejecting devices may be used, such as a serial scanning type printer that forms an image by conveying the recording medium S in the conveying direction while moving one or more recording heads 15 in the direction orthogonal to the conveying direction of the recording medium S, for example.

<Inkjet Recording Head>

Figure 3:
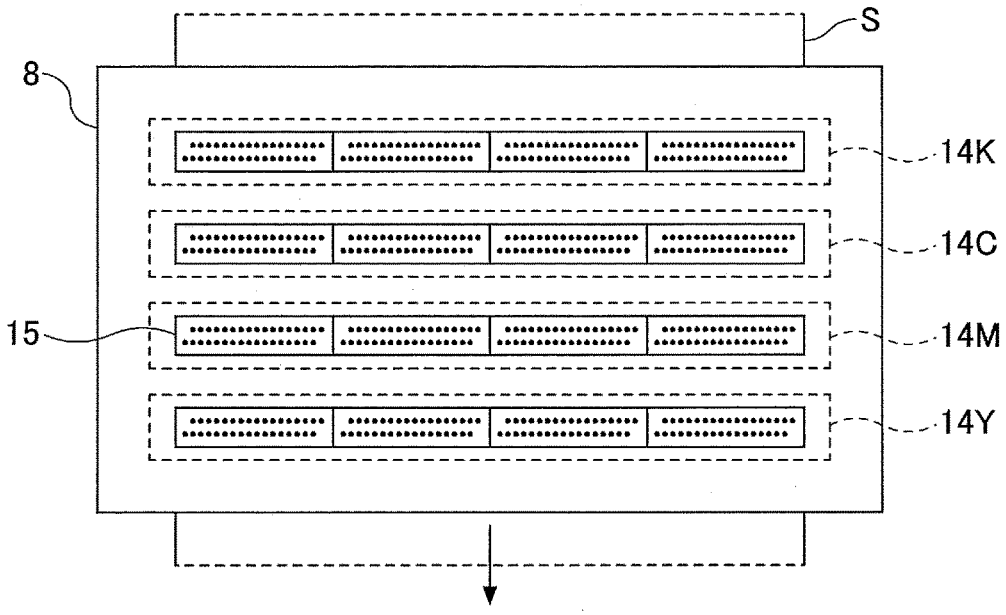
FIG. 3 is a schematic view of a recording head according to an embodiment of the present invention.

FIG. 3 is a schematic view of the recording head 15 having a line head structure. The recording head 15 illustrated in FIG. 3 includes an assembly of four head arrays 14K, 14C, 14M, and 14Y. The head array 14K for black ejects black-color ink droplets, the head array 14C for cyan ejects cyan-color ink droplets, the head array 14M for magenta ejects magenta-color ink droplets, and the head array 14Y for yellow ejects yellow-color ink droplets.

The head arrays 14Y, 14C, 14M, and 14Y extend in a direction orthogonal to the conveyance direction of the recording medium S (in the direction of the arrow in FIG. 3). By arranging the recording head 15 into arrays as described above, a wide printing region width may be achieved, for example.

Figure 4:
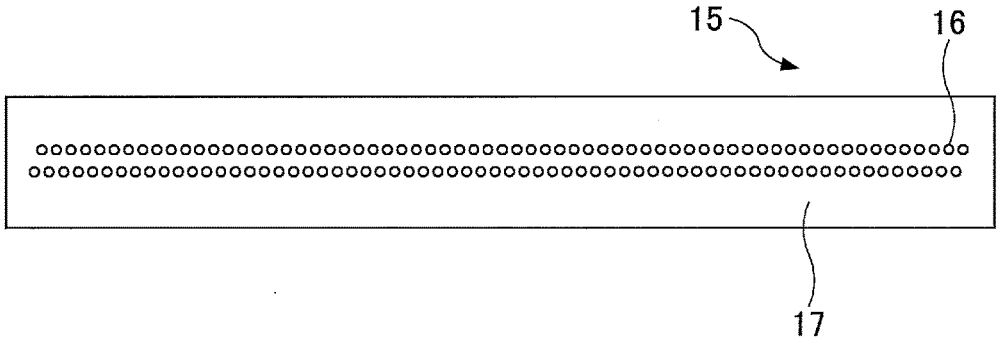
FIG. 4 is an enlarged bottom view of the recording head of FIG. 3.

FIG. 4 is an enlarged bottom view of the recording head 15 of FIG. 3. The nozzle face (bottom face) 17 of the recording head 15 has a plurality of nozzles 16 arranged in a staggered (zigzag) pattern. In the present embodiment, 64 of the nozzles 16 are arranged in one row, and two rows of the nozzles 16 are staggered with respect to each other. By arranging the plurality of nozzles 16 in a staggered arrangement in the manner described above, a high resolution image may be formed, for example.

FIG. 5 is an exploded perspective view of the recording head 15. The recording head 15 includes a nozzle plate 19, a pressure chamber plate 21, a restrictor plate 23, a diaphragm plate 26, the rigid plate 28, and a piezoelectric element group 35.

The channel plate 36 is configured by stacking the nozzle plate 19, the pressure chamber plate 21, the restrictor plate 23, and the diaphragm plate 26 in the above recited order, and then positioning and connecting the above plates 19, 21, 23, and 26.

The nozzle plate 19 has multiple nozzles 16 formed therein in a staggered arrangement. The pressure chamber plate 21 has multiple pressure chambers 20 corresponding to the nozzles 16 formed therein. Restrictors 22 are formed in the restrictor plate 23. The restrictors 22 communicate with a common ink channel 27 and the individual pressure chambers 20 and control the amount of ink flowing to the individual pressure generating chambers 20. The diaphragm plate 26 includes a vibration plate 24 and a filter 25.

The channel plate 36 is connected to the rigid plate 28 such that the filter 25 faces an opening of the common ink channel 27. An upper opening end of an ink guide pipe 30 is connected to the common ink channel 27 of the rigid plate 28. A lower opening end of the ink guide pipe 30 is connected to the ink tank 70 (see FIG. 2) that is filled with ink.

The piezoelectric element support substrate 32 includes a piezoelectric element drive IC (head drive IC) 33 and is configured to support the piezoelectric element 31. An electrode pad (piezoelectric pad) 34 is connected to the piezoelectric element drive IC 33. A drive waveform generated in the piezoelectric element drive IC 33 is applied to the piezoelectric element 31 via the electrode pad 34 (see FIG. 7).

The piezoelectric element group 35, which is configured by arranging a plurality of the piezoelectric elements 31, is attached to the rigid plate 28. The piezoelectric element group 35 is inserted into an opening 29 of the rigid plate 28, and free ends of the piezoelectric elements 31 are fixed and joined to the vibration plate 24. In this way, the recording head 15 is configured.

Note that in FIG. 5, the sake of simplicity, the number of the nozzles 16, the pressure chambers 20, the restrictors 22, and the piezoelectric elements 31 illustrated are less than the number that are actually included in the recording head 15.

<Residual Oscillation Detection>

Figure 6:
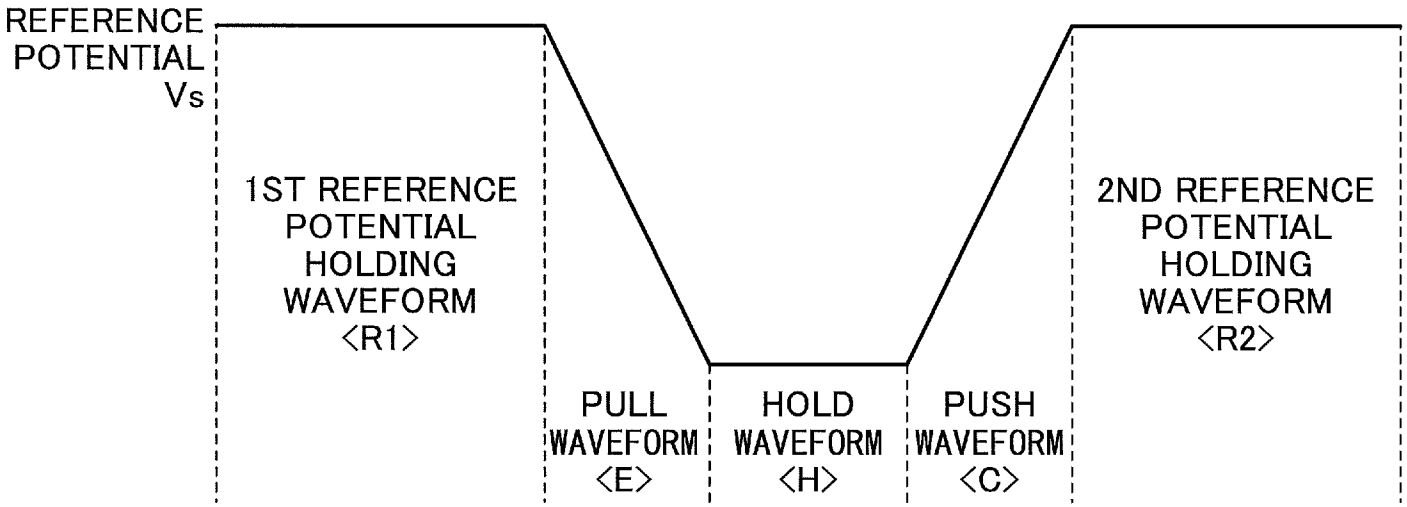
FIG. 6 is a diagram illustrating an example drive waveform applied to a piezoelectric element.

FIG. 6 illustrates a drive waveform to be applied to the piezoelectric element 31. The drive waveform includes a first reference potential holding waveform for holding a predetermined reference potential Vs, a PULL waveform for causing the piezoelectric element 31 to contract, a HOLD waveform for holding the contracted state of the piezoelectric element 31, a PUSH waveform for causing the piezoelectric element 31 to expand, and a second reference potential holding waveform.

Figure 7A:
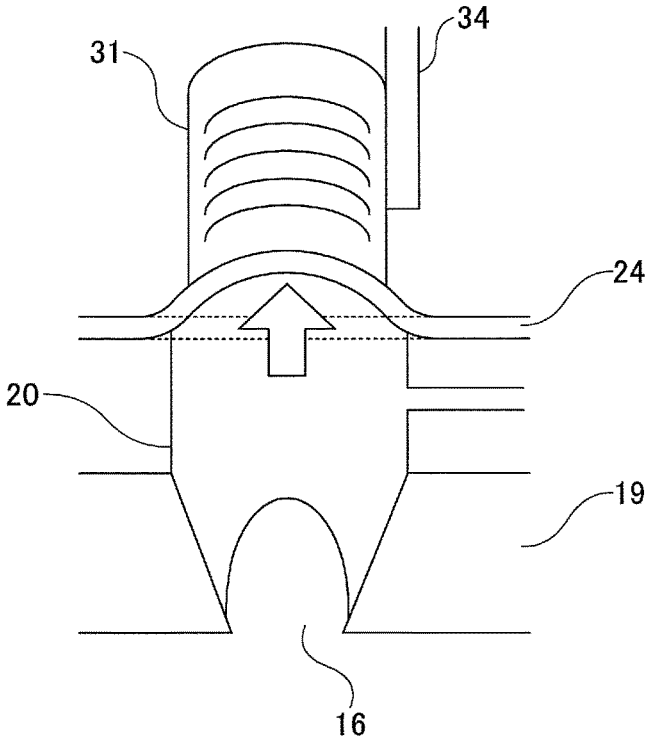
FIGS. 7A-7C are conceptual diagrams describing ink ejection and residual oscillation in a pressure chamber.
Figure 7B:
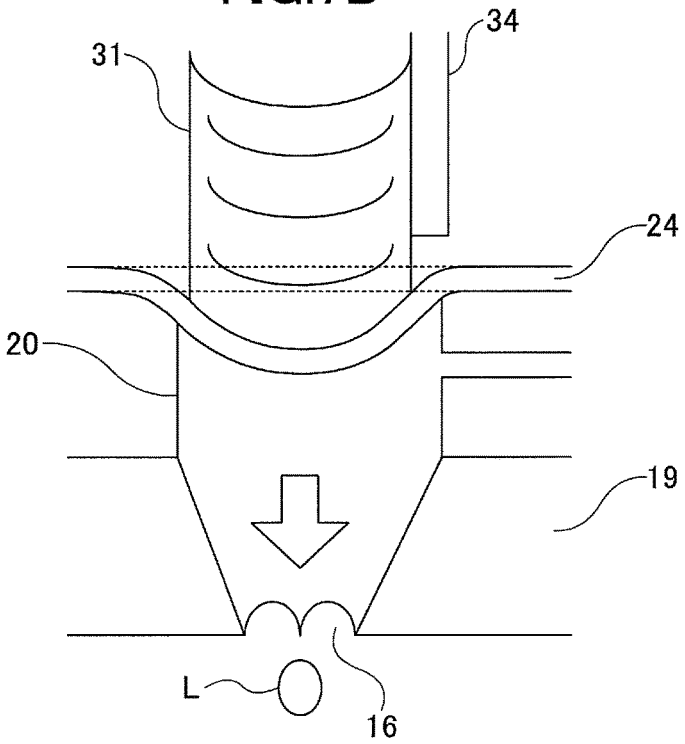
Figure 7C:
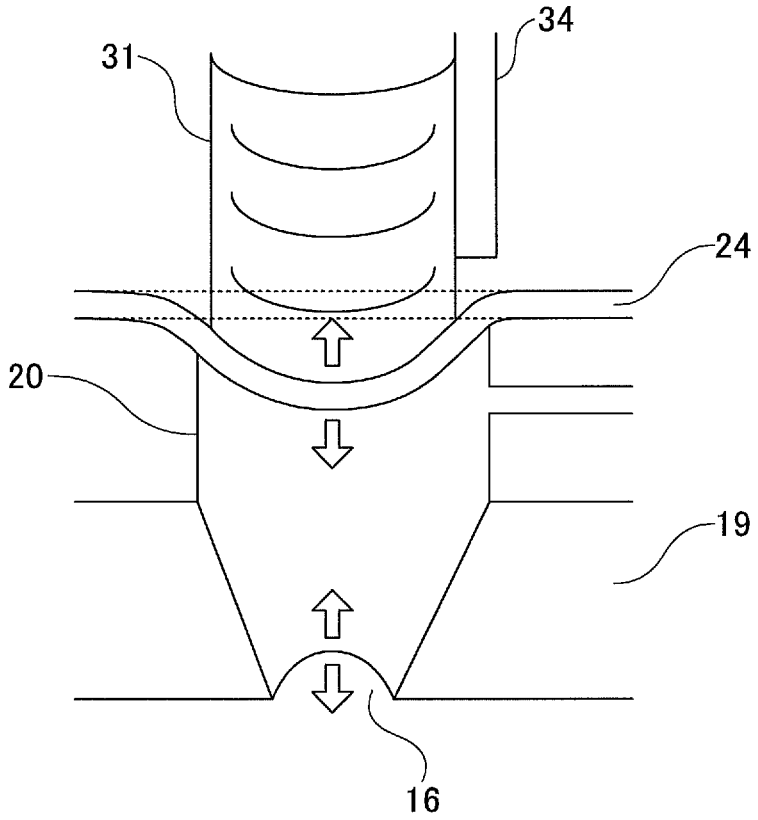

FIGS. 7A-7C are conceptual diagrams describing operations for ink ejection and residual oscillation in the pressure chamber 20. FIG. 7A illustrates when the pressure chamber 20 expands (E in FIG. 6), FIG. 7B illustrates when the pressure chamber 20 contracts (C in FIG. 6), and FIG. 7C illustrates a pressure change that occurs in the pressure chamber 20 after ink ejection and after a second reference voltage (potential) holding period R2 elapses.

During ink ejection as illustrated in FIGS. 7A and 7B, an analog switch (SW) 37 in the piezoelectric element drive IC 33 is turned ON/OFF in response to image data transmitted from the drive control substrate 18, and the drive waveform of FIG. 6 is applied to the electrode pad 34. A contraction/expansion force of the piezoelectric element 31 based on the drive waveform causes expansion/contraction (volume change) of the liquid chamber 20 and a pressure change in the liquid chamber 20 via the vibration plate 24, and in this way, a pressure in a direction toward the nozzle 16 is generated to eject the ink (liquid L).

Specifically, the PULL waveform of FIG. 6 is a falling waveform element for lowering the voltage from the reference voltage Vs. The period during which the falling waveform element is applied to the piezoelectric element 31 corresponds to a pressure chamber expansion period E in which the piezoelectric element 31 is contracted and the pressure chamber 20 is expanded and reduced in pressure via the vibration plate 24 as illustrated in FIG. 7A.

The HOLD waveform of FIG. 6 is a holding waveform element for holding the lowered potential. While the holding waveform element is applied to the piezoelectric element 31, ink is supplied from the supply path (ink guide pipe) 30 to the pressure chamber 20.

The PUSH waveform of FIG. 6 is a rising waveform element for raising the voltage from the lowered voltage to the reference potential Vs. The period during which the rising waveform element is applied to the piezoelectric element 31 corresponds to a pressure chamber contraction period C in which the piezoelectric element 31 is expanded and the pressure chamber 20 is contracted and increased in pressure as illustrated in FIG. 7B.

In reference voltage holding periods R1 and R2 in which the first reference potential holding waveform and the second reference potential waveform for holding the voltage to the predetermined reference potential (holding waveform element) Vs are applied to the piezoelectric element 31, the reference potential is applied from the electrode pad 34 to the piezoelectric element 31, and the vibration plate 24 is held in a substantially horizontal state.

After ink ejection and after the reference voltage holding period R2 elapses (FIG. 7C), the analog SW 37 for applying the drive waveform to the piezoelectric element 31 is turned OFF as described below, and as such, the piezoelectric element 31 and the vibration plate 24 are no longer controlled by the drive waveform. Thus, residual oscillation of the meniscus (nozzle surface) after ink ejection is propagated to the pressure chamber 20 as a wave and is transmitted to the piezoelectric element 31 via the vibration plate 24. In this way, a residual oscillation voltage is induced on the electrode pad 34.

By detecting the residual oscillation voltage change induced on the electrode pad 34 (i.e., potential at a predetermined detection time), a nozzle state (state of ink in the nozzle) can be determined.

Figure 8:
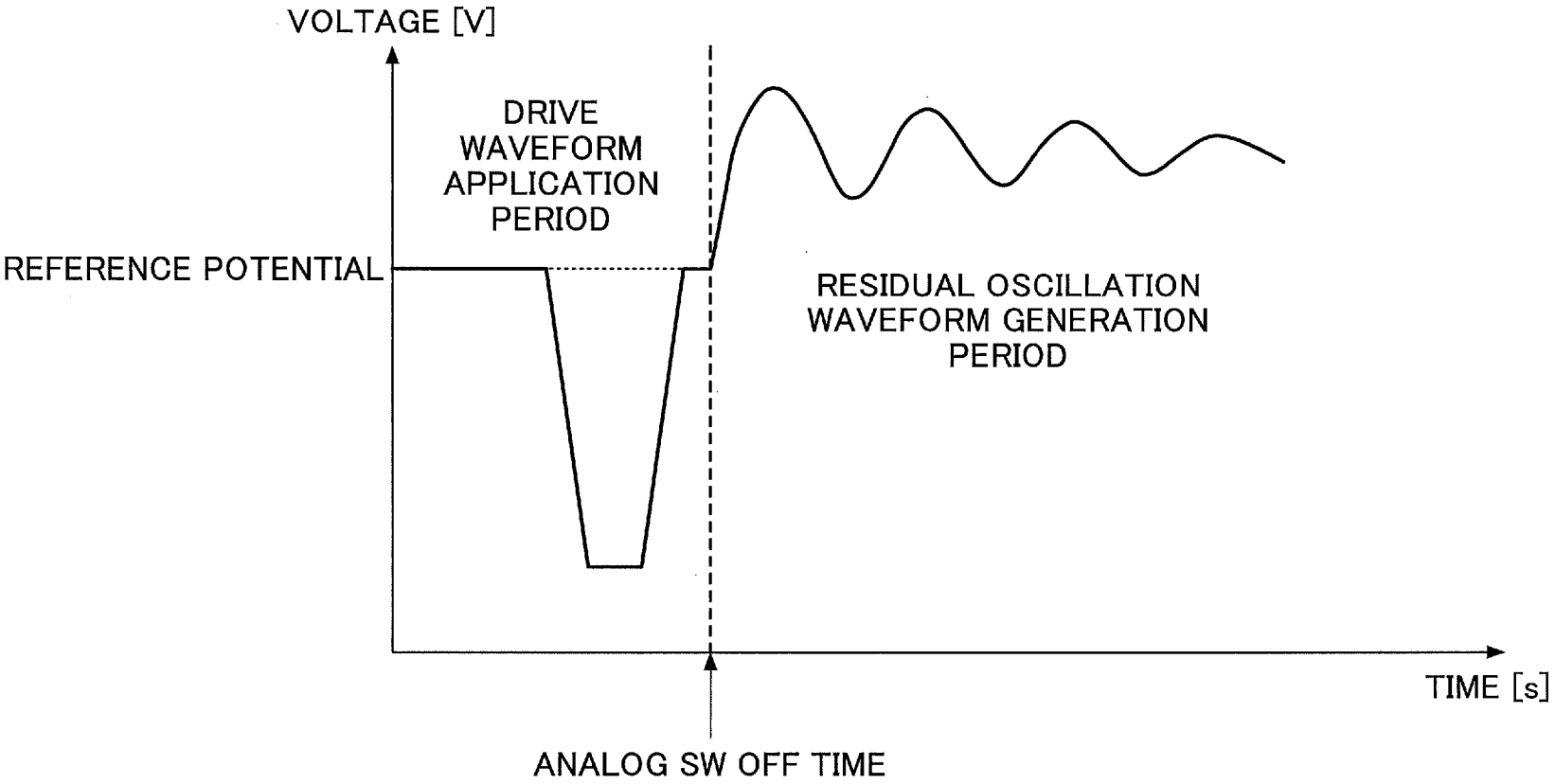
FIG. 8 is a diagram illustrating a drive waveform application period and a residual oscillation waveform generation period.

FIG. 8 illustrates a drive waveform application period and a residual oscillation waveform generation period.

The drive waveform application period of FIG. 8 corresponds to the period during which the above operation is performed for causing contraction of the piezoelectric element 31 by applying the PULL waveform (falling waveform element) of the drive waveform illustrated in FIG. 7A and causing expansion of the piezoelectric element 31 thereafter by applying the PUSH waveform (rising waveform element) of the drive waveform as illustrated in FIG. 7B to eject ink droplets.

The residual oscillation waveform generation period of FIG. 8 corresponds to the operation of FIG. 7C. The residual oscillation waveform is generated at the time the analog SW 37 (see FIG. 10) is turned OFF. The residual oscillation waveform is a damped oscillation waveform propagating a residual pressure wave to the piezoelectric element 31 via the vibration plate 24.

<Inkjet Recording Module Configuration>

FIG. 9 is a block diagram illustrating an example configuration of the inkjet recording module (liquid droplet ejecting device) including the recording head 15 and the drive control substrate 18 according to an embodiment of the present invention.

The drive control substrate 18 includes a control unit (drive control unit) 81, a drive waveform generation unit 82, and a storage unit 83. The storage unit 83 stores image data received from a main control unit 90, which controls the entire liquid droplet ejecting device. The control unit 81 generates a timing control signal and drive waveform data based on the received image data. The drive waveform generation unit 82 performs D/A conversion, voltage amplification, and current amplification on the generated drive waveform data to generate a drive waveform.

Digital signals such as the timing control signal generated by the control unit 81 of the drive control substrate 18 are transmitted to the recording head 15 by serial communication. The head substrate 60 of the recording head 15 receives the digital signals from the control unit 81, and a head control unit 61 (timing control signal) on the head substrate 60 de-serializes the digital signals and inputs the de-serialized digital signals to the piezoelectric element drive IC 33.

The drive waveform generated by the drive waveform generation unit 82 may be input to the piezoelectric element 31 based on the ON/OFF state of the analog SW 37 (see FIG. 10) within the piezoelectric element drive IC 33.

The state detection substrate 40 includes a detection unit 41 that detects the potential of a residual oscillation waveform generated according to the state of a nozzle and compares the detected potential with a threshold.

In the example of FIG. 9, the control unit 61 of the head substrate 60 of the ink jet recording head 15 includes a state determination unit 63. However, in other examples, the state determination unit 63 may be included in the control unit 81 of the drive control substrate 18.

The state determination unit 63, which may be arranged in the head control unit 61 or the control unit 81, determines the state of a nozzle and/or a pressure chamber (i.e., whether they are in abnormal states) based on the detection made by the detection unit 41, and determines whether to continue printing or stop printing, and whether to transition to a restoration operation, for example.

Note that abnormal states of the nozzle or the pressure chamber include a dry/viscous state (state where the nozzle is dry or the ink in the pressure chamber is viscous) and a bubble containing state where bubbles are contained in the pressure chamber.

The dry/viscous state includes a dry state of the nozzle where the surface of ink within the pressure chamber is exposed to external air via the opening of the nozzle upon performing continuous printing such that the ink surface at the nozzle becomes viscous (including partial thickening or solidification of the ink). The dry/viscous state also includes a viscous state where the overall viscosity of ink in the pressure chamber is increased (thickened) due to evaporation of the solvent in the ink which may be caused by continuous drive operations that change the ambient temperature and humidity to induce self-heating of the ink, for example, Also, the bubble containing state may occur when bubbles are introduced into the pressure chamber when the ink meniscus (surface) is pulled back into the nozzle along with bubbles during an ink ejection operation.

When the nozzle and/or the pressure chamber is in an abnormal state, the ink ejection speed may vary depending on each nozzle, abnormal images may be formed that have irregularities, such as uneven density, streaks, color variations, and further, as the thickening (viscosity increase) of ink progresses, the thickened ink may clog the nozzles (to cause ejection failure) and an image region may have missing dots (missing pixels) as a result, for example. Accordingly, the state determination unit 63 determines the state of the nozzle and the pressure chamber, and if the nozzle and/or the pressure is determined to be in an abnormal state, the state determination unit 63 determines an appropriate maintenance/restoration operation to be performed with respect to the nozzle and/or the pressure chamber.

Note that the drive control substrate 18 is connected to the main control unit 90, which corresponds to a superordinate control unit. The main control unit 90 is connected to the operation panel 91 and the maintenance/restoration unit 2.

Information based on the determination made by the state determination unit 63, such as whether to continue printing or stop printing, and/or whether to execute a restoration operation is transmitted to the main control unit 90 via the control unit 81. In turn, the main control unit 90 may continue printing or stop printing based on the information received from the state determination unit 63, and may direct the maintenance/restoration unit 2 to execute a restoration operation based on the received information, for example.

Alternatively, after information on the state of the nozzle and/or the pressure chamber determined by the state determination unit 63 (e.g., normal state, dry/viscous state, or bubble containing state) is transmitted to the main control unit 90 via the control unit 81, the received information may be displayed on the operation panel 91 such that a user may be notified of the state information. In this case, the user may select whether to continue printing or stop printing, and select whether to perform a restoration operation, for example.

By querying the user in the above-described manner, the intention of the user on whether to continue printing or tolerate abnormal image formation can be reflected. Note that the information reflecting the intention of the user does not necessarily have to be input via the operation panel 91. For example, the information reflecting the intention of the user may also be input by the control unit 90 or an external computer that is connected to the main control unit 90.

Detection Unit Configuration Example 1

Figure 10:
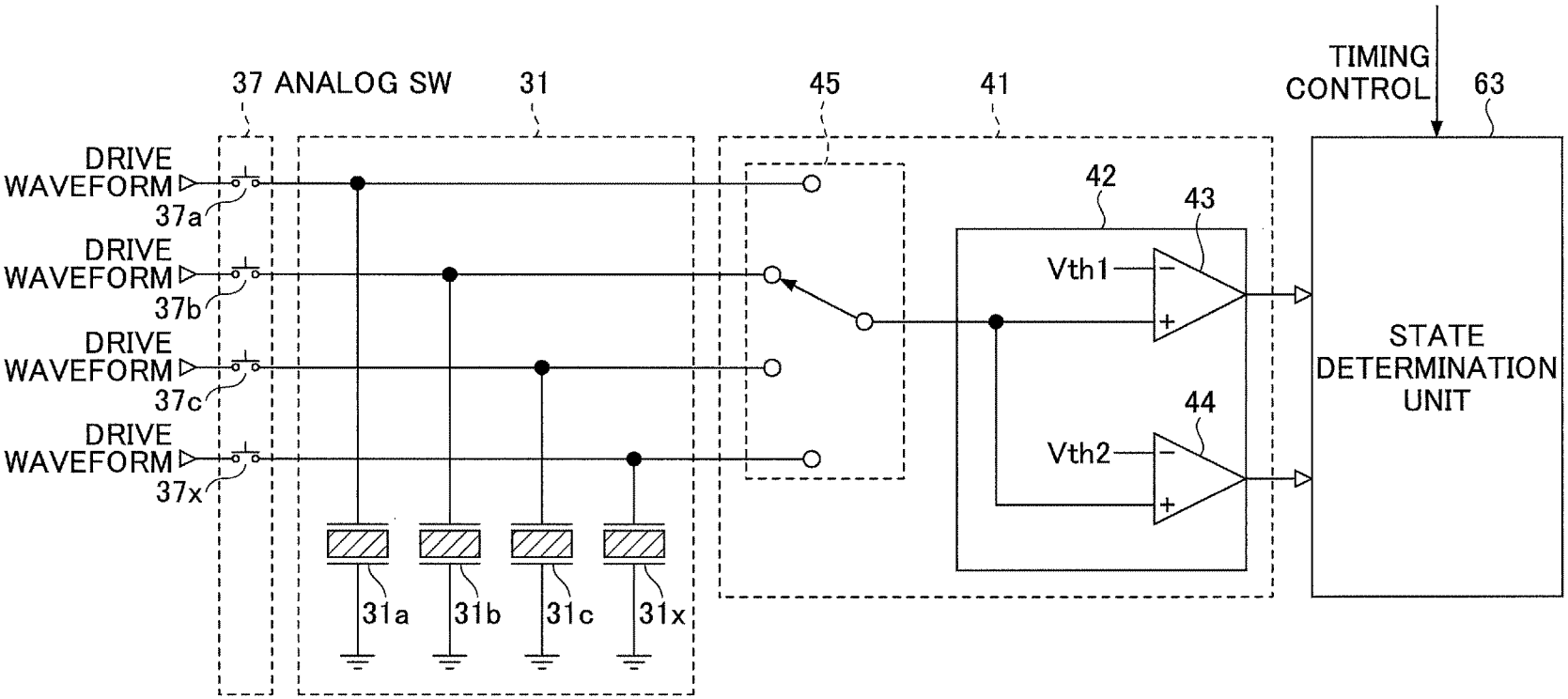
FIG. 10 is a circuit diagram illustrating an example configuration of a detection unit.

FIG. 10 is a circuit diagram illustrating an example configuration of the detection unit 41 of the state detection substrate 40. The detection unit 41 includes a comparison detection unit 42 and a switch unit 45.

The comparison detection unit 42 includes a first comparison unit 43 that compares a detected potential (voltage) with a first threshold Vth1 that is higher than the reference potential Vs, and a second comparison unit 44 that compares the detected potential (voltage) with a second threshold Vth2 that is lower than the reference potential Vs. The switch unit 45 switches the piezoelectric elements 31 corresponding to detection targets.

For example, the first and second comparison units 43 and 44 may be implemented by comparators, and the switch unit 45 may be implemented by a multiplexer.

Figure 11:
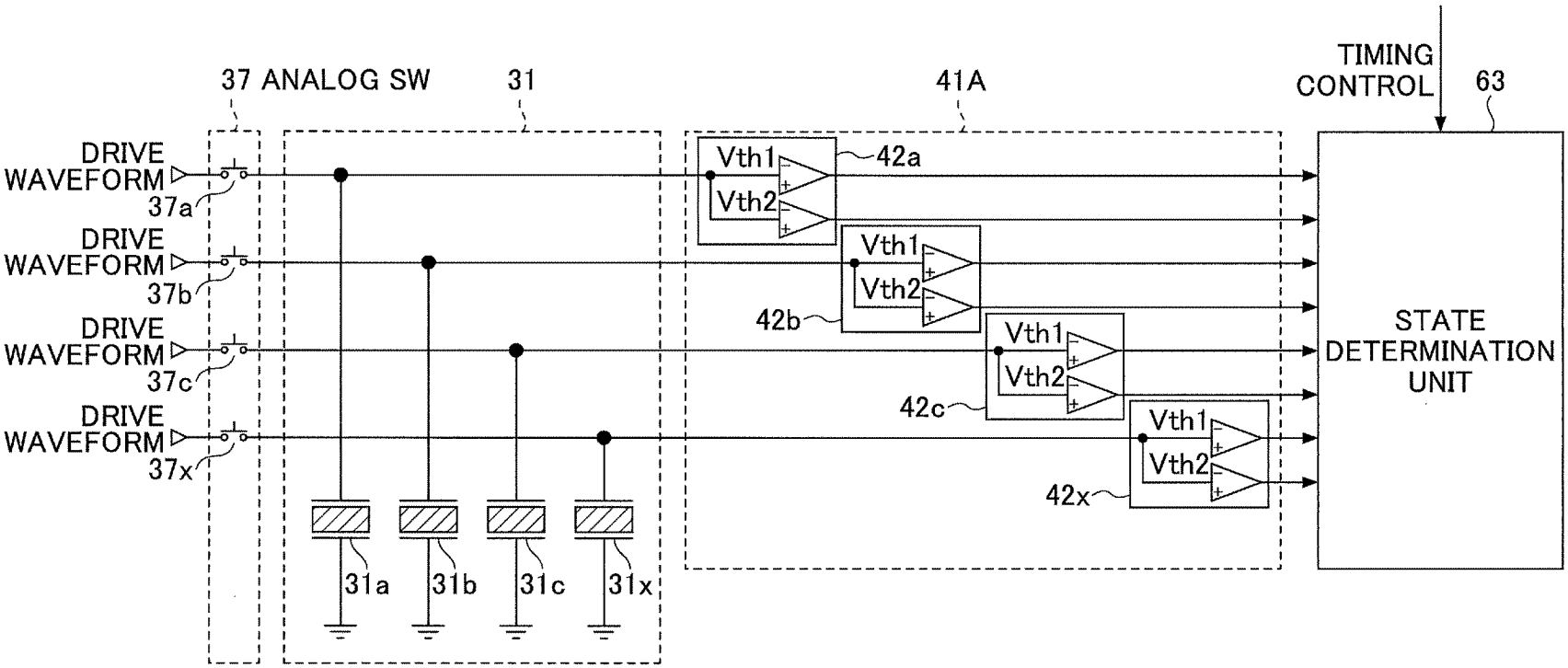
FIG. 11 is a circuit diagram illustrating another example configuration of the detection unit.

Note that in the case where two comparison units are included in the detection unit 41 as illustrated in FIGS. 10 and 11, a detected voltage Vrs may be compared with the first threshold Vth1, and the detected voltage Vrs may be compared with the second threshold Vth2. In this way, when detecting an abnormal state of a nozzle and/or a pressure chamber, a dry/viscous state of the nozzle or the pressure chamber and a bubble containing state of the pressure chamber may be separately detected, for example.

Note that at times immediately after the analog SW 37 is turned OFF and immediately after the switch unit 45 switches an input destination, switching noise tends to be superimposed on the residual oscillation waveform and the correlation between the nozzle state and potential difference is susceptible to influences from the noise. Accordingly, in order to prevent erroneous detection due to the influences of noise and to make accurate comparisons for the detected voltage, in preferred embodiments, a predetermined time period (mask period) may be excluded from detection, for example.

In order to exclude a predetermined time period from detection, the state determination unit 63, which is a downstream process unit of the detection unit 41, may be subjected to timing control by a timing control unit (control unit) 62 of the head control unit 61 such that the detected voltage may be masked the predetermined time period, for example.

Alternatively, the switch unit 45 may mask the detected voltage by not establishing connection between the comparison detection unit 42 and the piezoelectric element 31 corresponding to the detection target over a predetermined period from the time the analog SW 37 is turned OFF to the time detection is to be resumed, for example.

Further, in some embodiments, the detection unit 41 may be configured to use an AD converter instead of the comparison units 43 and 44 to convert a detected potential, for example.

According to an aspect of the present embodiment, the detection unit 41 only requires a comparison unit but does not require a high-pass filter and a low-pass filter for removing noise components, or a waveform shaping unit configured by a negative feedback amplifier, a voltage follower, and a counter, for example, for adjusting the amplitude.

In this way, circuit costs may be reduced and the substrate area may be reduced in the detection unit for detecting a residual oscillation according to the present embodiment.

Note that in the present example configuration, a common detection unit is used to detect residual oscillation by switching a detection target between the piezoelectric elements 31 corresponding to the plurality of nozzles 16 using the switch unit 45. In this way, the number of circuits in the liquid droplet ejecting device may be reduced.

Detection Unit Configuration Example 2

FIG. 11 is a circuit diagram illustrating another configuration example of the detection unit.

In FIG. 10, the detection unit 41 includes the switching unit 45 for switching the detection target as described above. However, a switch unit does not necessarily have to be included in a detection unit for detecting residual oscillation according to an embodiment of the present invention. For example, as illustrated in FIG. 11, a detection unit 41A may be used that includes comparison detection units 42*a* to 42*x* respectively corresponding to the piezoelectric elements 31*a* to 31*x*.

In the present configuration example, in order to prevent erroneous detection due to influences of switching noise from analog SWs 37*a* to 37*x*, the state determination unit 63 may be subjected to timing control by the timing control unit 62, and the state determination unit 63 may be configured to mask a detected voltage detected by the detection unit 41A to exclude the predetermined period from detection, for example.

In the present configuration example, the detection unit 41A includes a plurality of comparison units 42*a* to 42*x* respectively corresponding to the piezoelectric elements 31*a* to 31*x*. In this way, the residual oscillation of a plurality of piezoelectric elements may be simultaneously detected to enable detection at a higher speed.

According to an aspect of the present embodiment, the configuration of the detection unit may be suitably selected (e.g., example configuration 1 or example configuration 2) depending on the circuit scale and specific application of the detection unit, for example.

<Abnormal Ejection Detection Method>

Figure 12:
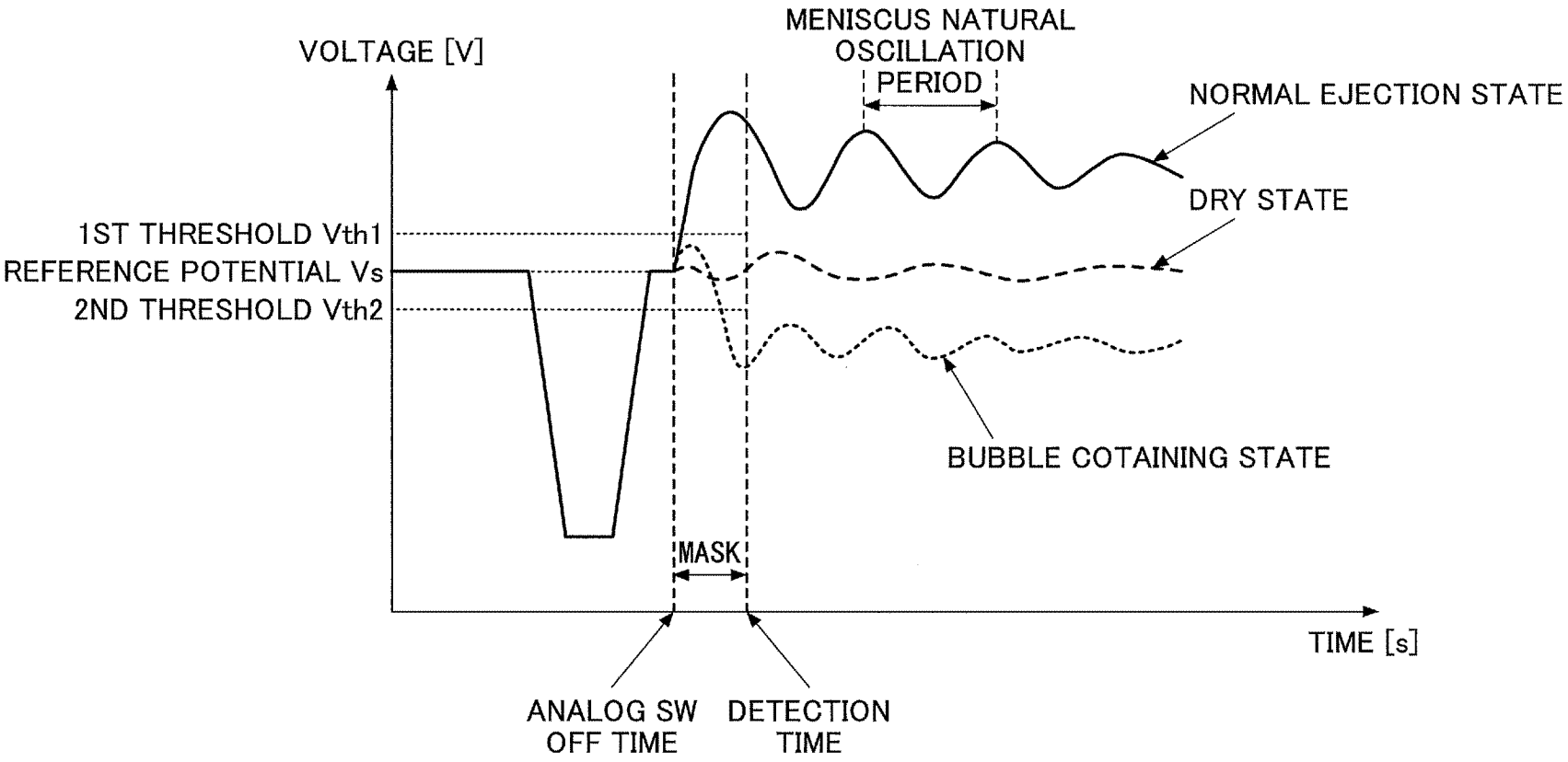
FIG. 12 is a diagram describing a detection method implemented by the detection unit arranged in the recording head according to an embodiment of the present invention.

FIG. 12 illustrates an example abnormal ejection detection method implemented by the detection unit of the recording head 15. According to FIG. 12, by applying a drive waveform and properly setting the detection time for detecting a voltage after the analog SW 37 is turned OFF, potential differences occur between a normal ejection state of a nozzle or a pressure chamber, a dry/viscous state of the nozzle or the pressure chamber (dry nozzle surface or viscous liquid within pressure chamber), and a bubble containing state of the pressure chamber communicating with the nozzle.

Note that the frequency of the residual oscillation in the normal ejection state is substantially equal to the natural oscillation frequency fc of the pressure chamber 20. A meniscus natural oscillation period for each nozzle may be individually determined based on the nozzle diameter, the pressure chamber volume, component members of the pressure chamber, for example.

In FIG. 12, Vs represents a reference potential, Vth1 represents a first threshold corresponding to a voltage (potential) higher than the reference potential Vs, Vth2 represents a second threshold corresponding to a voltage (potential) lower than the reference potential Vs.

Figures 13, 14A:
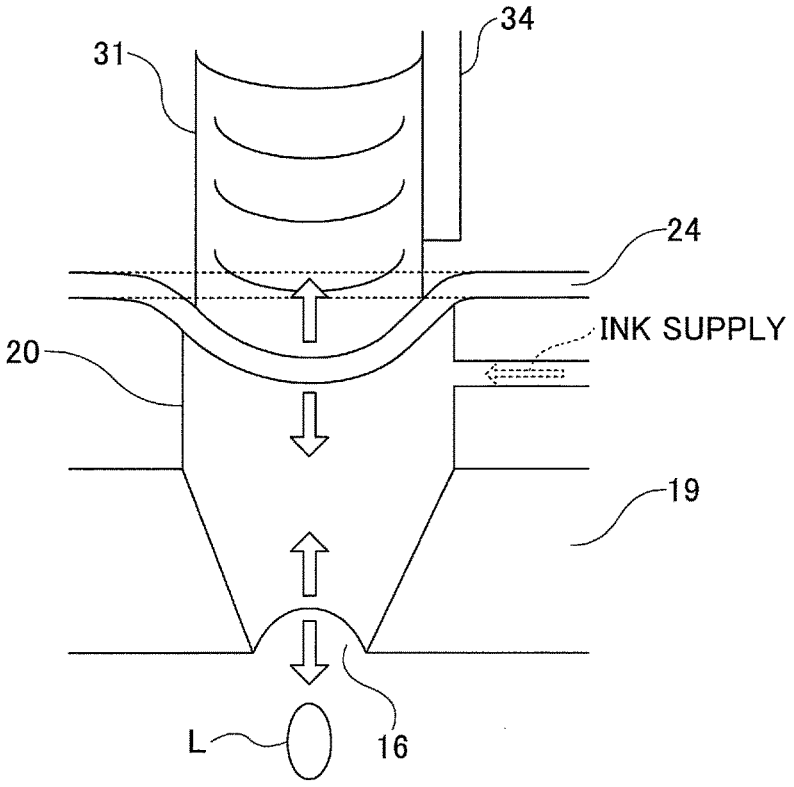
FIG. 13 is an example determination table for determining a nozzle state according to an embodiment of the present invention.
FIGS. 14A-14C are conceptual diagrams describing a potential difference generated with respect to each nozzle state.

FIG. 13 illustrates an example determination table for determining a nozzle state. The detection unit 41 may detect the nozzle state based on the potential differences as illustrated in FIG. 12.

For example, the first threshold value Vth1 corresponding to a potential higher than the reference potential Vs and the second threshold Vth2 corresponding to a potential lower than the reference potential Vs may be set up. At a detection time corresponding to a time after the detected voltage is masked for a predetermined mask period after the analog SW 37 is turned off, the nozzle state may be detected (determined) based on the relationship between the detected potential Vrs of the residual oscillation waveform, the first threshold Vth1, and the second threshold Vth2.

Note that at the time immediately after the analog SW 37 is turned OFF, switching noise tends to be superimposed on the residual oscillation waveform, and the potential difference indicating the nozzle state is susceptible to influences from the noise. Accordingly, in order to prevent erroneous detection due to the influences of noise and to make accurate comparisons for the detected voltage, a predetermined time period (mask period) is preferably excluded (masked) from detection.

Note that the predetermined period corresponding to the mask period is preferably arranged to be less than the meniscus natural oscillation period Tc of the nozzle. The mask period in relation to continuous drive operations is described below with reference to FIG. 15.

In the present example, the nozzle state is determined based on the potential Vrs of the residual oscillation waveform at the detection time indicated in FIG. 12 and comparisons of the detected voltage Vrs of residual oscillation with the thresholds Vth1 and Vth2.

That is, when the detected voltage Vrs is greater than the first threshold Vth (Vth1<Vrs), the nozzle and the pressure chamber are in normal ejection states. When the detected voltage Vrs is greater than the second threshold Vth2 and less than or equal to the first threshold Vth1 (Vth2<Vrs≤Vth1), the nozzle or the pressure chamber is in a dry/viscous state, meaning the nozzle surface is dry (partially thickened or solidified) or the entire liquid in the pressure chamber is thickened (increased in viscosity). When the detected voltage Vrs is less than or equal to the second threshold Vth2 (Vrs≤Vth2), this means that bubbles are included in the pressure chamber communicating with the nozzle (bubble containing state).

Note that the above predetermined ranges for the detected voltage Vrs are merely illustrative examples. For example, whether each of the predetermined ranges includes the threshold Vth1 or Vth2 or (≥ or ≤) or excludes the threshold Vth1 or Vth2 (> or <) may be changed as desired.

By determining the nozzle state using two thresholds including the first threshold value Vth1 and the second threshold value Vth2 as described above, the dry/viscous state of the nozzle or the pressure chamber (dry nozzle or viscous ink in the pressure chamber) and the bubble containing state of the pressure chamber may be separately determined as abnormal ejection states, and corresponding types of restoration operations to be implemented may be selected accordingly, for example.

On the other hand, in some embodiments, the dry/viscous state and the bubble containing state of a nozzle or a pressure chamber may be indiscriminately recognized as an abnormal state. In this case, only one threshold (first threshold Vth1) may be required as a comparison threshold, and whether the nozzle or the pressure chamber is in a normal ejection state or an abnormal ejection state may be determined by comparing the detected voltage Vrs with the first threshold Vth1, for example.

In this case, the detection unit of FIG. 10 or 11 may not require a switch unit or may only require one comparison unit, for example. In this way, circuit costs and the substrate area may be further reduced, for example.

Accordingly, in one aspect of the present embodiment, the number of thresholds set up in the detection unit may be suitably adjusted according to the circuit scale and the specific application of the detection unit, for example.

Figure 14B:
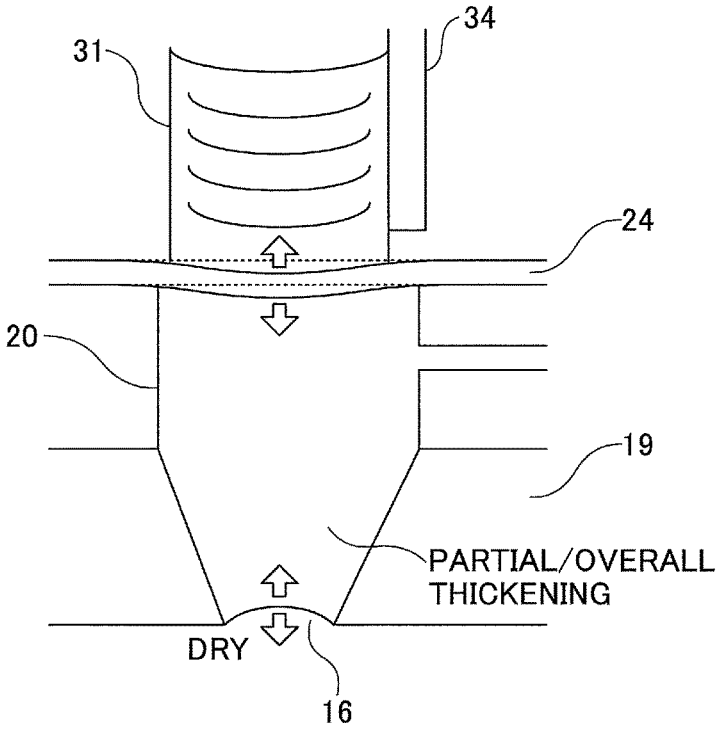
Figure 14C:
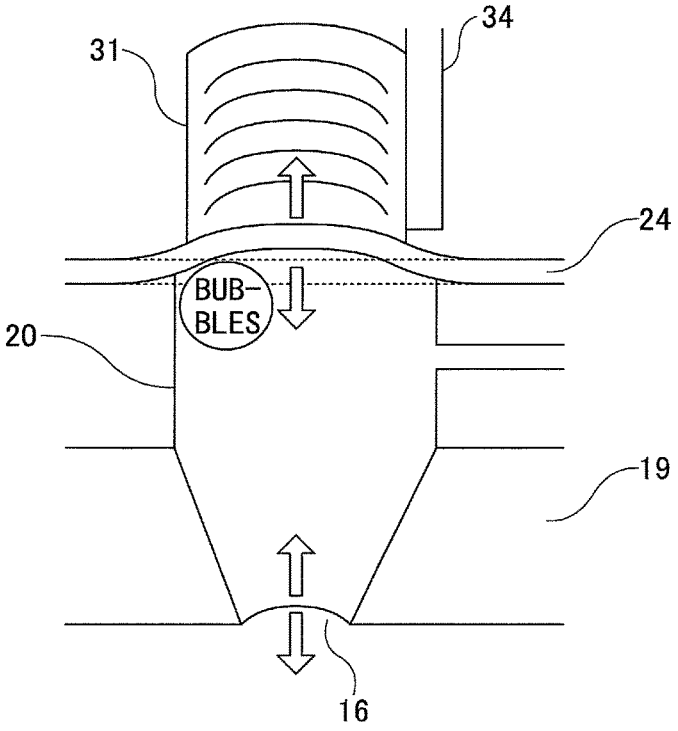

In the following, the potential difference generated with respect to each nozzle state is described with reference to FIGS. 14A-14C. FIG. 14A illustrates a normal ejection state, FIG. 14B illustrates a dry/viscous state, and FIG. 14C illustrates a bubble containing state.

In the normal ejection state as illustrated in FIG. 14A, residual oscillation of the meniscus is relatively large because it is after ink droplets (liquid droplets) have been ejected. Also, because ink droplets have been ejected, the volume within the pressure chamber 20 is smaller as compared with the volume before ink ejection. As such, the piezoelectric element 31 expands toward the nozzle 16.

That is, a residual oscillation waveform with large amplitude and an oscillation center at a potential higher than the reference potential Vs of the drive waveform and large amplitude can be observed at the electrode pad 34.

Note that although ink is supplied to the pressure chamber 20 after ink ejection, because the ink is supplied over a substantially longer period of time as compared with the residual oscillation period, at the detection time, the amount of ink in the pressure chamber 20 is still less than the amount before ink injection, and as such, the oscillation center of the residual oscillation waveform is held at a potential higher than the reference potential Vs.

As illustrated in FIG. 14B, when the surface of the nozzle 16 is dry (ink surface is partially thickened or solidified), or when the entire ink in the pressure chamber 20 is thickened (increased in viscosity), the residual oscillation of the meniscus is small. In this case, ink is not ejected, and as such, the volume of the pressure chamber 20 does not change. That is, when the nozzle or the pressure chamber is in the dry/viscous state, a residual oscillation waveform with small amplitude and an oscillation center at the reference potential Vs can be observed at the electrode pad 34.

In FIG. 14C, bubbles are contained in the pressure chamber 20, and the volume within the pressure chamber 20 is increased by the volume of the bubbles. Thus, the piezoelectric element 31 is contracted in the opposite direction of the nozzle 16. That is, in the bubble containing state, a residual oscillation waveform with small amplitude and an oscillation center at a potential lower than the reference potential Vs can be observed at the electrode pads 34.

Note that when abnormal states such as those illustrated in in FIGS. 14B and 14C are detected, a restoration operation, such as a flushing operation or a suction operation may be implemented.

For example, the flushing operation (idle ejection operation) may involve applying a drive waveform (restoration waveform) with a larger amplitude than the normal drive waveform to the piezoelectric element 31 of the inkjet recording module 8 without using the maintenance/restoration unit 2. With such an operation, dried ink (or thickened ink) at the nozzle 16 as illustrated in FIG. 14B may be discharged from the nozzle 16. This restoration operation may be carried out during a printing operation, for example.

The suction operation may involve using a nozzle cap, a tube, a tube pump, and a waste ink cartridge that are provided in the maintenance/restoration unit 2 to suck ink within the pressure chamber 20 through the nozzle cap and discharge the ink into the waste ink cartridge via the tube, for example. With such an operation, bubbles (gas) contained in the pressure chamber 20 as illustrated in FIG. 14C may be discharged and viscous ink as illustrated in FIG. 14B may be discharged from the nozzle 16. Note that the suction operation is carried out after stopping a printing operation.

Figure 15:
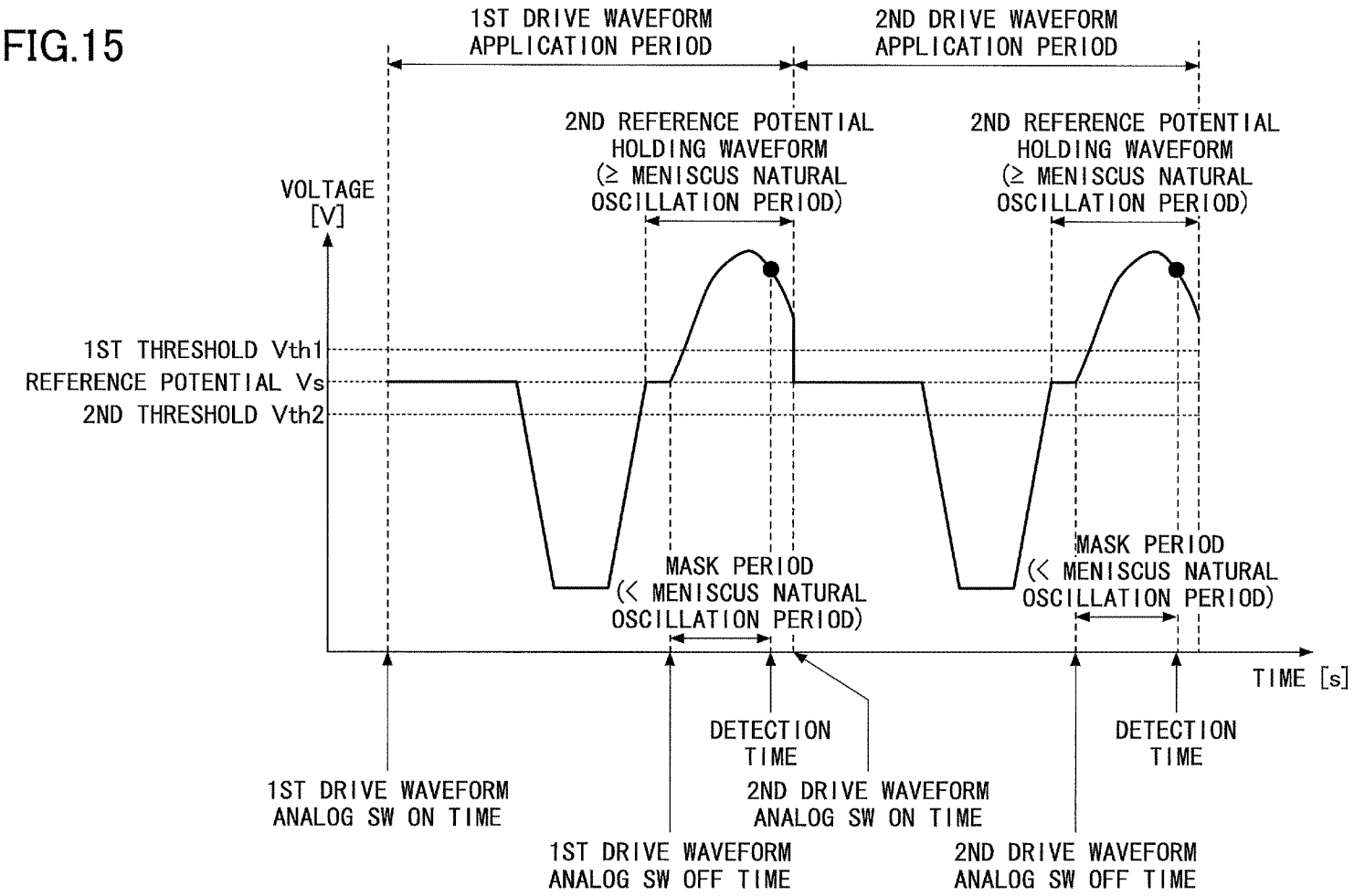
FIG. 15 is a diagram describing how nozzle state detection is performed without using a dedicated waveform and without decreasing productivity according to an embodiment of the present invention.

According to an aspect of the present embodiment, a nozzle state may be detected without using a dedicated waveform while maintaining desirably high productivity. FIG. 15 is a diagram for explaining how a nozzle state can be detected without using a dedicated waveform while maintaining high productivity according to an embodiment of the present invention.

The drive waveform to be applied to the piezoelectric element includes the first reference potential holding waveform, the PULL waveform, the HOLD waveform, and PUSH waveform, and the second reference potential holding waveform (see FIG. 6).

Also, generally, the times R1 and R2 for applying the first and second reference potential holding waveforms are set longer than one period of the meniscus natural oscillation period.

According to an embodiment of the present invention, assuming successive waveforms being applied are referred to as a first drive waveform and a second drive waveform, the detection time at which the state of a nozzle or a pressure chamber is to be detected corresponds to a time point after a mask period has elapsed. The mask period starts when the analog SW 37 is turned OFF during application of the second reference potential holding waveform of the first drive waveform and is shorter than one period of the meniscus natural oscillation period of the nozzle.

Note that the meniscus natural oscillation period may vary with respect to each nozzle. Thus, in a preferred embodiment, the meniscus natural oscillation periods of the plurality of nozzles included in the inkjet recording head may be taken into account, and the mask period may be set up to be shorter than the shortest meniscus natural oscillation period.

Also, note that detection of a residual oscillation for determining the state of a nozzle or a pressure can be carried out instantaneously by comparing the potential detected at the detection time. For example, in the detection according to the present embodiment, it may be unnecessary to detect a continuous change in the residual oscillation voltage over a predetermined period to be used for calculating the attenuation ratio based on the period and amplitudes of the residual oscillation, for example. Accordingly, after detecting the potential for determining the state of a nozzle at the detection time, operations with respect to the same nozzle may promptly move on to application of the next drive waveform, for example.

By instantaneously completing detection of the residual oscillation through potential measurement after the mask period, the detection may be made at a time earlier than when the analog SW 37 is turned ON to apply the second drive waveform. Thus, the detection of the residual oscillation after application of the first drive waveform does not influence the application of the second drive waveform.

In this way, the state of a nozzle or a pressure chamber may be instantaneously detected without using a dedicated waveform while maintaining the printing speed for applying successive drive waveforms. That is, abnormal ejection may be detected without lowering productivity.

<Overall Control>

Figure 16:
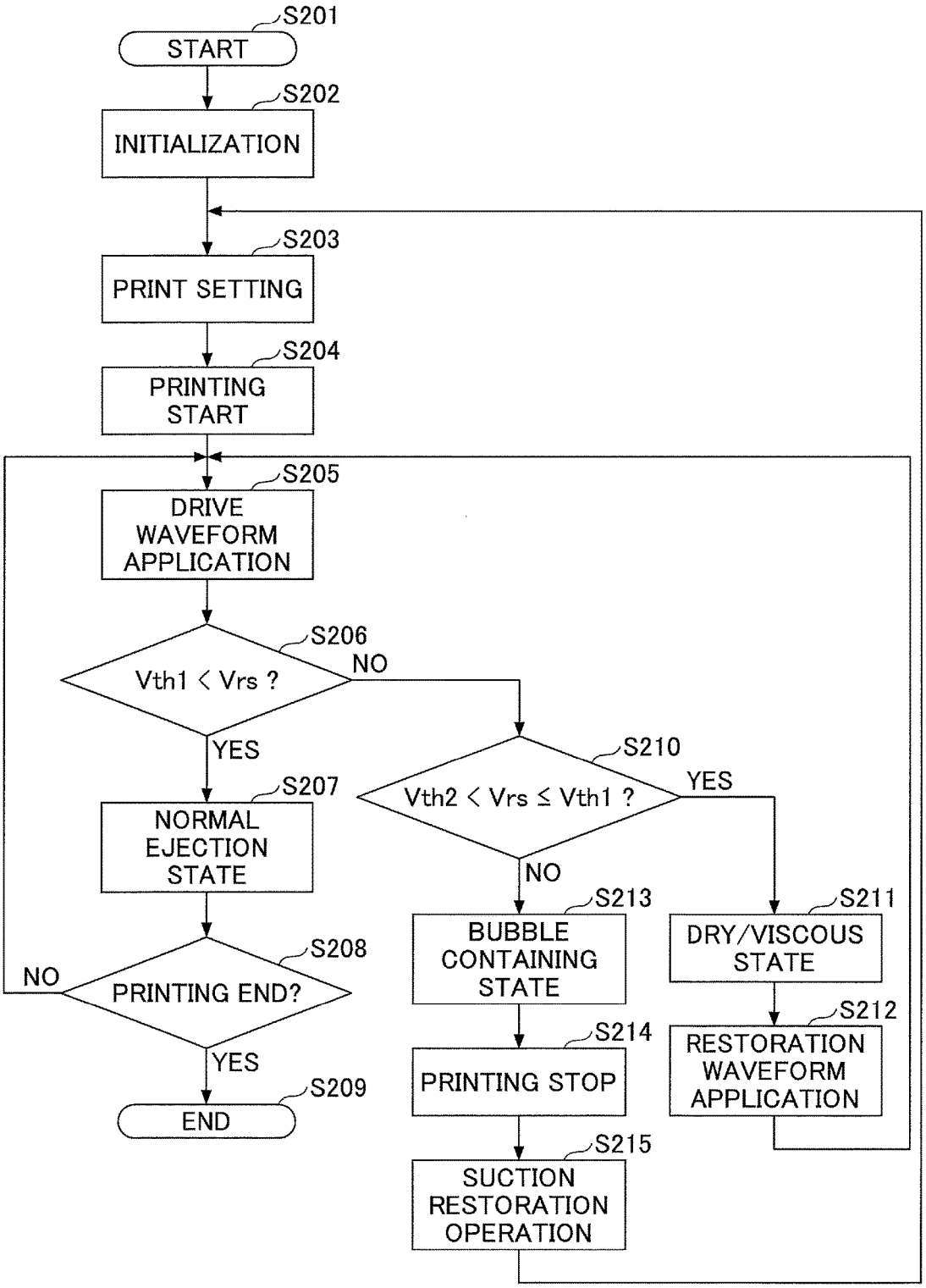
FIG. 16 is a flowchart illustrating an overall control process of the inkjet recording apparatus according to an embodiment of the present invention.

FIG. 16 is a flowchart illustrating an overall control process (print control and abnormal ejection detection) of the inkjet recording apparatus according to an embodiment of the present invention. Such a control process may be stored as a program to be executed by the main control unit 90 or some other computer, for example.

First, after starting the present process (step S201), performing initialization (step S202), and specifying print settings relating to the image, the resolution, the conveying speed, and other correction values, for example (step S203), a printing operation may be started (step S204).

During the printing operation, the drive waveform generation unit 82 applies a drive waveform (ejection drive pulse) for determining the state of a nozzle and a pressure chamber (step S205).

Then, a determination is made as to whether the detected voltage Vrs of the residual oscillation generated after application of the drive waveform in step S205 is greater than the first threshold Vth1 (Vth1<Vrs?) (step S206). Specifically, the detection unit 41 compares the detected voltage Vrs with the first threshold Vth1 to determine their relationship.

If the detected voltage Vrs is determined to be greater than the threshold Vth1 (Yes in step S206), the state determination unit 63 determines that the nozzle and the pressure chamber are in normal ejection states (step S207).

The control unit 81 determines whether the printing operation has ended (step S208). If it is determined that the printing operation has not ended (No in step S208), this means that the printing operation is ongoing, and the process returns to step S205 where the drive waveform generation unit 82 applies a drive waveform to the piezoelectric element 31 again (step S205).

Then, the detection unit 41 determines whether the detected voltage Vrs of the residual oscillation generated after applying the drive waveform in step S205 is greater than the first threshold Vth1 (Vth1<Vrs?) to determine whether the nozzle or the pressure chamber is in an abnormal state (step S206).

Note that when the determination results in step S206 continue to be positive determinations indicating normal ejection states of the nozzle and the pressure chamber (Yes in step S206), the processes of steps S205-S208 may be repeatedly performed while switching the nozzle corresponding to the abnormal ejection detection target during the printing operation. Then, once the printing operation is ended (Yes in step S208), the overall control process may also be ended (step S209).

On the other hand, when it is determined S206 that the detected voltage Vrs is less than or equal to the first threshold Vth1 (Vth1 Vrs) (No in step S206), the process proceeds to step S210.

In step S210, the detection unit 41 determines whether the detected voltage Vrs is greater than the second threshold Vth2 and less than or equal to the first threshold value Vth1 (Vth2<Vrs≤Vth1?).

When it is determined that the detected voltage Vrs is greater than the second threshold Vth2 and less than or equal to the first threshold value Vth1 (Vth2<Vrs≤Vth1) (Yes in step S210), the state determination unit 63 determines that the nozzle 16 or the pressure chamber 20 is in a dry/viscous state (step S211).

When it is determined that the nozzle 16 or the pressure chamber 20 is in a dry/viscous state, a restoration waveform is applied to the piezoelectric element 31 to perform idle ejection at times where the inkjet recording head is disposed at a non-printing area (in between pages). In this way, dry ink (partially thickened/solidified ink) at the nozzle 16 or thickened ink in the pressure chamber 20 may be discharged to refresh the nozzle 16 (step S212).

Note that the restoration waveform is a waveform that has a larger voltage amplitude difference than the drive waveform. The restoration waveform causes an abrupt pressure change in the pressure chamber 20 to thereby enable ejection (idle ejection) of dry ink or thickened ink in the nozzle 16 or the pressure chamber 20 that has compromised mobility due to partial/overall viscosity increase, for example.

Such a restoration operation through idle ejection (step S212) can be promptly performed even during a printing operation. Thus, after carrying out such idle ejection operation, the process may proceed to applying the next drive waveform (return to step S205).

On the other hand, when it is determined in step S210 that the detected voltage Vrs does not satisfy the condition Vth2<Vrs≤Vth1 (No in step 210), this means that the detected voltage Vrs is less than the second threshold Vth2 (Vrs<Vth2), and the state determination unit 63 determines that the pressure chamber 20 communicating with the nozzles 16 is in a bubble containing state (step S213).

In this case, the printing operation is stopped (step S214), and the suction restoration operation for sucking ink from the nozzle 16 is performed (step S215). The suction restoration operation involves attaching a suction device to a nozzle surface 17 to suck out dry ink, thickened ink, and/or bubbles contained in the pressure chamber 20.

In order to implement the suction restoration operation of step S215, the printing operation has to be stopped. Thus, after carrying out the suction restoration operation, the process returns to the print setting process of step S203.

Note that in the case of detecting the state of the nozzle and the pressure chamber by only distinguishing two states, i.e., a normal ejection state or an abnormal ejection state, the processes of steps S210 and subsequent process steps may be omitted, and when a negative determination ("No") is made in step S206, an appropriate restoration operation may be performed, for example.

Also, in some embodiments, when an abnormal ejection state is detected, a query may be made to the user regarding the execution of a restoration operation (whether to execute a restoration operation, the type of restoration operation to be executed, etc.), for example.

Further, in some embodiments, the processes of steps S214 and S215 may be omitted such that the printing operation will not be stopped even when the bubble containing state is detected. In this case, the process may proceed to step S203 while continuing the printing operation and the user may be notified of the nozzle 16 communicating with the pressure chamber 20 that has been detected to contain bubbles, for example. In this way, the user may select whether to continue the printing operation or stop the printing operation and whether to execute a restoration operation, for example.

Although the present invention has been described above with reference to certain illustrative embodiments, the present invention is not limited to these embodiments, and numerous variations and modifications may be made without departing from the scope of the present invention.

What is claimed is:

1. A liquid droplet ejecting device comprising:

a liquid droplet ejecting head including a nozzle, a pressure chamber that accommodates liquid and is in communication with the nozzle, and a piezoelectric element that is arranged to face the pressure chamber;

a drive waveform generation unit configured to generate a drive waveform for driving the piezoelectric element, the drive waveform having a potential that varies with respect to a reference potential;

wherein the reference potential is for a holding waveform which holds the piezoelectric element at a predetermined reference voltage prior to or subsequent to applying a waveform which expands or contracts the piezoelectric element;

a detection unit configured to detect a relationship between a detected potential of a residual oscillation waveform that is generated within the pressure chamber after driving the piezoelectric element and a first threshold corresponding to a potential higher than the reference potential of the drive waveform; and a state determination unit configured to determine whether at least one of the nozzle and the pressure chamber is in an abnormal state based on the detected relationship between the detected potential of the residual oscillation waveform and the first threshold.

2. The liquid droplet ejecting device according to claim 1, wherein the drive waveform includes a falling waveform element for lowering a voltage from the reference potential to a lower potential to cause contraction of the piezoelectric element and expansion of the pressure chamber, a holding waveform element for holding the lower potential, and a rising waveform element for raising the voltage from the lower potential to the reference potential to cause expansion of the piezoelectric element and contraction of the pressure chamber.

3. The liquid droplet ejecting device according to claim 2, wherein the state determination unit masks detection for a predetermined mask period after the rising waveform element of the drive waveform has reached the reference potential, and reads the detected potential of the residual oscillation waveform detected by the detection unit at a detection time after the predetermined mask period has elapsed; and the state determination unit determines the state of the nozzle at the detection time after the predetermined mask time period has elapsed.

4. The liquid droplet ejecting device according to claim 3, wherein the liquid droplet ejecting head includes a plurality of the nozzles; and the predetermined mask period set up by the state determination unit is less than a shortest meniscus natural oscillation period of a plurality of meniscus natural oscillation periods of the plurality of nozzles included in the liquid droplet ejecting head.

5. The liquid droplet ejecting device according to claim 1, wherein when the detected potential of the residual oscillation waveform detected by the detection unit is greater than the first threshold, the state determination unit determines that the nozzle and the pressure chamber are in normal states; and when the detected potential of the residual oscillation waveform detected by the detection unit is less than or equal to the first threshold, the state determination unit determines that at least one of the nozzle and the pressure chamber is in the abnormal state.

6. The liquid droplet ejecting device according to claim 1, wherein the detection unit includes a first comparison unit configured to compare the detected potential of the residual oscillation waveform generated within the pressure chamber after driving piezoelectric element with the first threshold.

7. The liquid droplet ejecting device according to claim 1, wherein the liquid droplet ejecting head includes a plurality of the nozzles, a plurality of the pressure chambers that accommodate liquid and are in communication with the nozzles, and a plurality of the piezoelectric elements that are arranged to face the pressure chambers; and the detection unit includes a switch unit configured to select a detection target from among the plurality of piezoelectric elements.

8. The liquid droplet ejecting device according to claim 1, wherein the liquid droplet ejecting head includes a plurality of the nozzles, a plurality of the pressure chambers that accommodate liquid and are in communication with the nozzles, and a plurality of the piezoelectric elements that are arranged to face the pressure chambers; and the detection unit is provided for each of the piezoelectric elements included in the liquid droplet ejecting head.

9. The liquid droplet ejecting device according to claim 1, wherein the detection unit detects a relationship between the detected potential and the first threshold, and a relationship between the detected potential and a second threshold corresponding to a potential lower than the reference potential;

when the detected potential of the residual oscillation waveform detected by the detection unit is greater than the first threshold, the state determination unit determines that the nozzle is in a normal state;

when the detected potential of the residual oscillation waveform is less than or equal to the first threshold and greater than the second threshold, the state determination unit determines that the nozzle is in a dry state or the liquid within the pressure chamber is in a viscous state; and when the detected potential of the residual oscillation waveform is less than or equal to the second threshold, the state determination unit determines that the pressure chamber is in a bubble containing state.

10. The liquid droplet ejecting device according to claim 9, wherein the detection unit includes a second comparison unit configured to compare the detected potential of the residual oscillation waveform generated within the pressure chamber after driving of the piezoelectric element with the second threshold.

11. An image forming apparatus comprising:

a liquid droplet ejecting device according to claim 1; and a control unit configured to implement a restoration process for restoring at least one of the nozzle and the pressure chamber based on a state of the nozzle determined by the state determination unit.

12. The image forming apparatus according to claim 11, wherein the restoration process for restoring at least one of the nozzle and the pressure chamber includes an operation for applying a restoration waveform having a larger amplitude than the drive waveform to the piezoelectric element during a printing operation to discharge viscous liquid from the nozzle.

13. The image forming apparatus according to claim 11, further comprising:

a suction restoration unit;

wherein the suction restoration unit stops a printing operation and executes a suction restoration operation as the restoration process for restoring at least one of the nozzle and the pressure chamber.

14. The image forming apparatus according to claim 11, wherein the restoration process to be implemented can be selected from a plurality of restoration operations.

15. A method for detecting abnormal ejection of a liquid droplet ejecting head, which includes a nozzle, a pressure chamber that accommodates liquid and is in communication with the nozzle, and a piezoelectric element that is arranged to face the pressure chamber, the method comprising steps of:

generating a drive waveform for driving the piezoelectric element, the drive waveform having a potential that varies with respect to a reference potential;

wherein the reference potential is for a holding waveform which holds the piezoelectric element at a predetermined reference voltage prior to or subsequent to applying a waveform which expands or contracts the piezoelectric element;

detecting a relationship between a detected potential of a residual oscillation waveform that is generated within the pressure chamber after driving the piezoelectric element and a first threshold corresponding to a potential higher than the reference potential of the drive waveform; and determining whether at least one of the nozzle and the pressure chamber is in an abnormal state based on the detected relationship between the detected potential of the residual oscillation waveform and the first threshold.

16. A non-transitory computer-readable medium storing a program that, when executed, causes a computer to perform the method for detecting abnormal ejection of a liquid droplet ejecting head according to claim 15.

* * * * *